US005579019A

United States Patent [19]

Uematsu et al.

[11] Patent Number: 5,579,019

[45] Date of Patent: Nov. 26, 1996

[54] SLOTTED LEAKY WAVEGUIDE ARRAY ANTENNA

[75] Inventors: Masahiro Uematsu, Kimitsu; Takashi Ojima, Chiba; Nobuharu Takahashi, Tokyo; Naohisa Goto, 15-1-A514, Tsuchihashi-6-chome, Miyamae-ku, Kawasaki-shi; Jiro Hirokawa, Tokyo; Makoto Ando, Kawasaki, all of Japan

[73] Assignees: Nippon Steel Corporation, Tokyo; Naohisa Goto, Kawasaki, both of Japan

[21] Appl. No.: 580,787

[22] Filed: Dec. 29, 1995

Related U.S. Application Data

[63] Continuation of Ser. No. 169,215, Dec. 20, 1993, abandoned.

[30] Foreign Application Priority Data

Oct. 7, 1993 [JP] Japan ..... 5-276152

[51] Int. Cl.[6] ..... H01A 13/10

[52] U.S. Cl. ..... 343/771; 343/770

[58] Field of Search ..... 343/771, 767, 343/770; H01Q 13/10, 13/18, 13/20, 13/22

[56] References Cited

U.S. PATENT DOCUMENTS

| | | | |
|---|---|---|---|
| 3,032,762 | 5/1962 | Kerr | 343/771 |
| 3,701,162 | 10/1972 | Seaton | 343/771 |
| 4,916,458 | 4/1990 | Goto | 343/771 |

FOREIGN PATENT DOCUMENTS

| | | | |
|---|---|---|---|
| 0029004 | 1/1989 | Japan | H01Q 13/10 |
| 5129828 | 5/1993 | Japan | H01Q 13/22 |

OTHER PUBLICATIONS

Furukawa, et al. "Beam Tilt Type Planar Antenna Using Waveguide of Single–Layer Structure for Receiving Broadcast by Satellite", Technical Report of IEICE (The Institute of Electronics, Information and Communication Engineers), AP88–40, Jul. 1988.

Ohmaru "Mobile Reception Apparatus for Broadcast by Satellite", Broadcasting Technology, vol. 43, No. 9, pp. 119–123, Sep. 1990.

Kuramoto, et al. "Antenna System for Mobile DBS Reception", Proceedings of the General Meeting of IEICE in Spring, 1991, B–59, Mar. 1991.

Nishikawa "Mobile Antenna System for Receiving Broadcast by Satellite", Toyoda Chuo Research R&D Review, vol. 27, No. 1, p. 65, Mar. 1992.

Hirokawa, et al. "Design of Slotted Leaky Waveguide Array Antenna", Technical Report of IEICE, AP92–37, 1992–5.

Nakano, et al. "Curl Antenna (III) Beam Tilt", Proceedings of the General Meeting of IEICE in Spring, B–45, Mar. 1993.

(List continued on next page.)

*Primary Examiner*—Donald T. Hajec
*Assistant Examiner*—Tho Phan
*Attorney, Agent, or Firm*—Pollock, Vande Sande & Priddy

[57] ABSTRACT

A slotted leaky waveguide array antenna of a one-axis tracking type wherein a feed section including a feed probe is kept in a stationary state to thereby keep a converter in a stationary state and a desired beam width is set in a tilt direction, includes a plurality of radiation waveguides arranged adjacent and parallel to each other, each of which has a plurality of slots arranged in a waveguide axial direction, and a feed waveguide for distributing to the respective radiation waveguides electromagnetic waves received through a feed section from a converter, and the antenna rotates in a substantially horizontal plane to track an azimuth direction, wherein the feed waveguide has a first section extended along one ends of the radiation waveguides and a second section extended from the feed section provided in the rotary center of the slotted leaky waveguide array antenna to the center of the first section, and wherein the radiation waveguides are formed with crossed slots having an identical offset, and the number of the crossed slots is preferably selected between 13 and 17.

12 Claims, 12 Drawing Sheets

OTHER PUBLICATIONS

Takano, et al. "System for Mobile BS Reception on Small Passenger Car", Proceedings of the General Meeting of IEICE in Spring, 1993, B–46, Mar. 1993.

Fujita, et al. "Study of System for Mobile BS Reception on Airplane", Proceedings of the General Meeting of IEICE in Spring, 1993, B–47, Mar. 1993.

Shibata, et al. "Characteristics of Radial Line Microstrip Array Antenna Having Large Tilt Angle", Proceedings of the General Meeting of IEICE in Spring, 1993, B–54, Mar. 1993.

J. Hirokawa, et al. "Waveguide—Junction With an Inductive Post", IEICE Trans. Electron, vol. 75, No. 3, pp. 348–352, Mar. 1992.

N. Marcuvits "Waveguide Handbook", IEE Electromagnetic Wave Series 21, Peter Peregrins Ltd., Chaps. 5&6, 1986. no month.

J. Hirokawa, et al. "A Single–Layer Multiple–Way Power Divider for a Planar Slotted Waveguide Array", IEICE Trans. Commun., vol. 75, No. 8, pp. 781–787, Aug. 1992.

Mizuno, et al. "E–Plane Curve 4–Power Distributor", Proceedings of the General Meeting of IEICE in Spring, 1989, C–788, Mar. 1989.

J. Hirokawa, et al. "An Analysis of a Waveguide T Junction With an Inductive Post", IEEE Trans. Microwave Theory Tech., vol. 39, No. 3, pp. 563–566, Mar. 1991.

J. Hirokawa, et al. "Matching Slot Pair for a Circularly–Polarized Slotted Waveguide Array", IEE Proc., vol. 137, Pt. H, No. 6, pp. 367–371, Dec. 1990.

Kiyohara, et al. "Design of a Crossed Slot Array Antenna On a Leaky Waveguide", Technical Report of IEICE, AP91–75, Sep. 1991.

J. Hirokawa, M. Ando and N. Goto "Analysis of Slot Coupling in a Radial Line Slot Antenna for DBS Reception" IEE Proc., vol. 137, pt. H, No. 5, pp. 249, 254, Oct. 1990.

J. Hirokawa, et al. "Design of a Crossed Slot Array Antenna on a Leaky Waveguide", Technical Report of IEICE AP92–37, EMCJ 92–20, May 22, 1992.

Technical Report of IEICE. AP93–25, SAT93–8 (May 1993).

FRESNEL DIRECTIVITIES IN TILT PLANE

SLOTTED LEAKY WAVEGUIDE ARRAY ANTENNA

This application is a Continuation of U.S. patent application Ser. No. 08/169,215, filed Dec. 20, 1993 now abandoned.

FIELD OF THE INVENTION

The present invention relates to a slotted leaky waveguide array antenna which is mounted on a moving vehicle for reception of satellite broadcasting waves.

BACKGROUND OF THE INVENTION

As satellite broadcasting spreads widely these years, various sorts of antennas for reception of satellite broadcasting waves designed for mounting on vehicles have been studied. References of such typical antennas and antennas related thereto include:

(1) Furukawa et al.: "Beam Tilt Type Planar Antenna using Waveguide of Single-Layer Structure for Receiving Broadcast by Satellite", Technical Report of IEICE (The Institute of Electronics, Information and Communication Engineers), AP88-40, July 1988.

(2) Ohmaru: "Mobile reception apparatus for broadcast by satellite", Broadcasting Technology, vol. 43, no. 9, pp. 119–123, September 1990.

(3) Kuramoto et al.: "Antenna System for Mobile DBS Reception", Proceedings of the General Meeting of IEICE in Spring, 1991, B-59, March 1991.

(4) Nishikawa: Mobile Antenna System for Receiving Broadcast by Satellite, Toyoda Chuo Research R&D Review, vol. 27, no. 1, p65, March 1992.

(5) Hirokawa et al.: "Design of Slotted Leaky Waveguide Array Antenna", Technical Report of IEICE, AP92-37, 1992-5.

(6) Nakano et al.: "Curl Antenna (III)- Beam Tilt", Proceedings of the General Meeting of IEICE in Spring, B-45, March 1993.

(7) Takano et al.: "System for Mobile BS Reception on Small Passenger Car", Proceedings of the General Meeting of IEICE in Spring, 1993, B-46, March 1993.

(8) Fujita et al.: "Study of System for Mobile BS Reception on Airplane", Proceedings of the General Meeting of IEICE in Spring, 1993, B-47, March 1993.

(9) Shibata et al.: "Characteristics of Radial Line Microstrip Array Antenna having Large Tilt Angle", Proceedings of the General Meeting of IEICE in Spring, 1993, B-54, March 1993.

(10) J. Hirokawa et al.: "Waveguide π-Junction with an Inductive Post", IEICE Trans. Electron, vol. 75, no. 3, pp. 348–351, March 1992.

(11) N. Marcuvits: "Waveguide Handbook", IEE Electromagnetic Wave Series 21, Peter Peregrins Ltd., Chaps. 5&6,1986.

(12) J. Hirokawa et al.: "A Single-Layer Multiple-Way Power Divider for a Planar Slotted Waveguide Array", IEICE Trans. Commun., vol. 75, no. 8, pp. 781–787, August 1992

(13) Mizuno et al.: "E-Plane Curve 4-Power Distributor", Proceedings of the General Meeting of IEICE in Spring, 1989, C-788, March 1989.

(14) J. Hirokawa et al.: "An Analysis of a waveguide T Junction with an Inductive Post", IEEE Trans. Microwave Theory Tech., vol. 39, no. 3, pp. 563–566, March 1991.

(15) J. Hirokawa et al.: "Matching Slot Pair for a Circularly-Polarized Slotted Waveguide Array", IEE Proc., vol. 137, pt. H, no. 6, pp. 367–371, December 1990.

(16) Kiyohara et al.: "Design of a crossed Slot Array Antenna on a Leaky Waveguide", Technical Report of IEICE, AP91-75, September 1991.

(17) J. Hirokawa, M. Ando and N. Goto: "Analysis of Slot Coupling in a Radial Line Slot Antenna for DBS Reception" IEE Proc., vol. 137, pt. H, no. 5, pp. 249–254, October 1990.

(18) J. Hirokawa et al.; "Design of a Crossed Slot Array Antenna on a Leaky Waveguide", Technical Report of IEICE A.P 92-37, EMCJ92-20, May 22, 1992.

With respect to such an antenna for reception of broadcast by satellite, since the antenna is to be mounted on a roof or the like of the automotive vehicle running on a road on which heights of the cars are legally restricted, one of important technical problems of such an antenna is to reduce the antenna height. Further, since the signal reception antenna is to be on a limited area on the roof of the car, another important technical problem is to minimize the antenna mounting area. In order to reduce the mounting height of the signal reception antenna, such a planar antenna of a structure that has a beam tilt angle and is designed to be mounted on the roof of the car is preferably considered.

In the case of an antenna for reception of satellite broadcast designed for mounting on a car, for the purpose of enabling the signal reception antenna to catch at all times the direction of the broadcasting satellite which varies with time as the car moves, the antenna is required to have a tracking mechanism for controlling the azimuth and elevation angles of the antenna. The tracking mechanism, however, constitutes a considerable part of the whole antenna manufacturing cost and also increases the mounting height and area of the antenna. Thus, it is important to eliminate or minimize such a drawback. Since the azimuth varies throughout 360 degrees with the movement of the car, it becomes necessary to realize the tracking of the azimuth direction by a mechanical rotary mechanism. Meanwhile, since the elevation angle is caused by a latitude range (about 20 degrees, for example, for vehicles in Japan) or by a slope of road relative to horizon level, that is, by a road slope within about ±5 degrees, the range of elevation change is relatively limited. For this reason, when the main beam width of the antenna in the elevation direction is previously set wider than the above values, a non-tracking system not for performing the mechanical tracking in the elevational direction can be employed to result in economy of the signal reception system, as a whole.

Referring to the aforementioned documents (2), (4), (7) and (8), it is difficult for a planar antenna using microstrips to realize more than 30 degrees of beam tilt angle, so that, when it is desired to obtain a beam tilt angle of about 50 degrees, the antenna must be installed to be inclined by about 20 degrees from the horizontal plane. In this case, the height of the inclined antenna determines the height of the entire signal reception system, which disadvantageously involves increase of the mounted height of the signal reception system when mounted on a vehicle. In order to reduce the antenna height, the antenna is divided into a plurality of subarrays.

Referring to the aforementioned documents (6) and (9), a planar antenna using radial waveguide path has a circular shape. For this reason, when it is desired for the planar antenna to be rotated about its center for tracking in the azimuth direction, a useless space can be removed and thus its mounting area can be decreased. In the case of the planar antenna using radial waveguide path, however, in order to obtain a large beam tilt angle while suppressing its side lobe, a substrate must be made of material having a high dielectric constant and antenna elements must be arranged in a close positional relationship. It seems very difficult to manufacture such an antenna in a mass production at the current technical level. In addition, because of the circular antenna, its beam width has a low degree of design flexibility.

Disclosed in the aforementioned documents (1), (3) and (5) is a slotted leaky waveguide array antenna which comprises a plurality of radiation waveguides provided therein with a plurality of slots along their electromagnetic-wave propagating direction and arrayed adjacent to each other in the same direction as the wave propagating direction and also comprises a feed waveguide for composing a wave of electromagnetic waves received by the respective radiation plate waveguides and transmitting the wave to a converter. This slotted leaky waveguide array antenna is considered to have an advantage that the beam width and antenna gain can be adjusted substantially independently of each other, depending on the number of such slots made in the respective radiation waveguides and the number of such radiation waveguides. Further, since the antenna disclosed in the above documents (1) and (5) is of a single-layer structure type, it is advantageous that a slot plate having respective slot patterns formed by etching is mounted on the waveguides of a groove structure by laser fusing, whereby an inexpensive and simple antenna can be manufactured.

The above prior art slotted leaky waveguide array antenna has many advantages including the above. However, in this antenna, as described in the document (5), a coupling part of the feed waveguides to the converter is provided at one end of the antenna. For this reason, when it is desired for the antenna to be rotated about its center for tracking in the azimuth direction, the antenna must have such a structure that the converter is fixedly mounted to the rear side of the antenna to be rotated together with the antenna. This requires the rotary mechanism to have a large load, which results in that a response performance is reduced, the vibration and shock caused by the rotation are applied to the converter, whereby the electronic circuit of the converter may be deteriorated.

SUMMARY OF THE INVENTION

It is an object of the present invention to provide a slotted leaky waveguide array antenna which can eliminate the need for rotating a converter together with the antenna and thus which can keep a feed section including the converter in a stationary state.

As already explained above, the main beam width of the slotted leaky waveguide array antenna in the elevational angle direction is considered to be adjusted by the number of slots to be formed in respective radiation waveguides. However, such a specific design criterion is still unknown that, with use of what slot number, a desired beam width of about ±5 degrees and a maximum antenna gain can be realized. Also unknown is the number of leaky waveguides to realize the desired antenna gain in a range of the optimum slot numbers.

Another object of the present invention is to provide a slotted leaky waveguide array antenna of a non-tracking type which can provide a desired main beam width in an elevational angle direction by determining an optimum number of slots to be formed in respective leaky waveguides through electromagnetic analysis or experiments.

A further object of the present invention is to determine the number of radial waveguides in a slotted leaky waveguide array antenna to obtain a necessary antenna gain in the above optimum slot number range.

In accordance with an aspect of the present invention, the above first object is attained by providing a slotted leaky waveguide array antenna which a feed waveguide comprises a first section extended along first ends of the radiation waveguides and a second section extended from a feed section provided in the rotary center of the slotted leaky waveguide array antenna to the center of the first section between the radiation waveguides.

In accordance with another aspect of the present invention, the above second object is attained by providing a slotted leaky waveguide array antenna which slots formed in the respective radiation waveguides are crossed slots having an identical offset and the number of such crossed slots are set to be arbitrary.

In the present invention, the feed waveguide comprises the first section corresponding to the prior art feed waveguide and the second section extended from the center of the antenna to the center of the first section to be perpendicular to the first section to thereby form a T junction, whereby the feed section can be positioned in the rotary center of the antenna. Electromagnetic waves received at the radiation waveguides are propagated into the second section from the rotary center through the first section of the feed waveguide, and then supplied through the feed section provided at its one end to a converter. As a result, only the antenna can be rotated in its horizontal plane while the feed section positioned at the rotary center of the antenna and the converter connected thereto are kept in the stationary state at all times.

In the present invention, when an arbitrary number of crossed slots having the same offset are formed in the respective radiation waveguides, a beam width of about ±5 degrees can be realized while allowing a maximum gain fluctuation of 2.5 dB in the tilt angle direction. This fact has been confirmed by our simulation.

DESCRIPTION OF THE PREFERRED EMBODIMENTS

Figure 1:
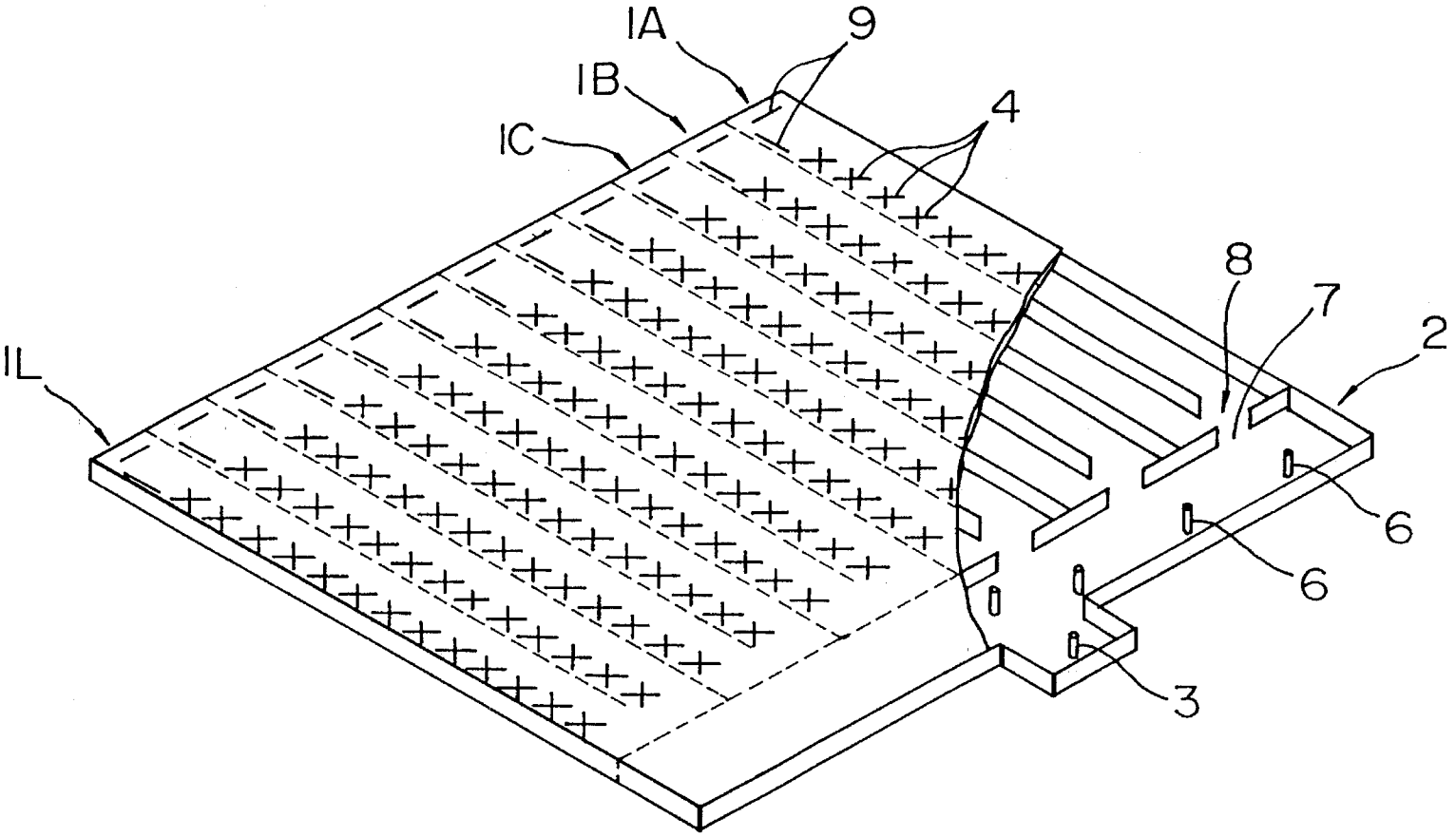
FIG. 1 is a perspective view of a slotted leaky waveguide array antenna in accordance with an embodiment of the present invention.

Referring to FIG. 1, there is shown a perspective view of a slotted leaky waveguide array antenna in accordance with an embodiment of the present invention. The antenna comprises 12 radiation waveguides 1A, 1B, 1C, . . . , and 1L arranged adjacent and parallel to each other and a feed waveguide 2 for composing a wave of electromagnetic waves received at the respective radiation waveguides and supplying it to a converter. Although the number of such radiation waveguides is preferably about 16, 12 radiation waveguides are illustrated in the drawing for convenience of explanation. Each of the radiation waveguides 1A to 1L is provided in its upper surfaces with a plurality of crossed slots 4 along its axial direction.

Explanation will be made as to the feed waveguide 2. The feed waveguide 2 is formed in the same plane as the radiation waveguides 1A to 1L. Such an antenna of a single-layer structure has a two-dimensional structure which is uniform in its thickness direction. Thus the antenna can be facilitated in its analysis and can have a structure suitable for mass production. The feed waveguide 2, as disclosed in documents (10) and (12), is made up of a plurality of waveguide π-junctions each with a post which have are connected in cascade and which both ends short-circuited. When the wide wall width of the feed waveguide 2 is set so that the wavelength in the waveguide of the feed waveguide is twice the wide wall width (including wall thickness) of the radiation waveguides 1A to 1L, a coupling window 7 of each of the π junctions can be coupled to be in phase with adjacent two of the radiation waveguides. Each of the π junctions is provided with a single inductive post 6. The inductive post 6, as disclosed in the document (11), acts to suppress the reflection of electromagnetic waves from the coupling window 7 of the corresponding π junction to realize excitation of traveling wave to the associated feed waveguide and also acts to suppress the shortening of the wavelength in the feed waveguide caused by the electromagnetic coupling of the coupling window 7. That is, the wavelengths in the radiation waveguides 1A to 1L become nearly constant independently of the coupling degrees of the π junctions and therefore the feed waveguides can be arranged as equally spaced.

As disclosed in the literature (7), the coupling degrees of the respective π junctions are adjusted so that power can be distributed with the equal amplitude and phase to all the radiation waveguides 1A to 1L. More specifically, the amplitude of the coupling degree is adjusted according to the width of the coupling window 7 of the π junction, while the phase is adjusted according to the length of a notch 8. As disclosed in the literatures (13) and (14), in order to facilitate matching of the feed waveguide at a feed probe 3, a waveguide T junction with an inductive post is used for power supply. Even when it is desired to directly insert the feed probe 2B into the center of a feed waveguide 3, sufficient matching can be realized throughout a wide frequency band with use of a matching pin or the like.

Explanation will next be made as to the radiation waveguides 1A to 1L. Each of the radiation waveguides 1A to 1L comprises an array of the crossed slots 4 closely arranged and a pair of slots made in a terminating end of the radiation waveguide for matching of circularly-polarized wave radiation. The slot pair 9 of the circularly-polarized wave radiation, as disclosed in the aforementioned literature (15), is designed to suppress wave reflection from the terminating end of the slotted leaky waveguide array antenna and also to radiate circularly polarized waves in the tilted main beam direction. In the case of the present antenna, in order to obtain a wide main beam width in its elevational direction, it is necessary to decrease the number of crossed slots, for which reason each slot must have a large coupling degree.

Referring to the literature (16), a beam tilt angle θ is given by the following equation.

$$\sin\theta=\lambda o/\lambda g+\alpha \quad (1)$$

The first term in the above equation is a value based on a leaky wave principle determined by wavelength λg in the waveguide. The wavelength λg in the waveguide is given by the following equation having a wide wall width ar.

$$\lambda g=\lambda o/[1-(\lambda o/2ar)^2]^{1/2} \quad (2)$$

The second term α in the equation (1) is a perturbation term associated with the transmitted wave of the in-waveguide caused by the slot coupling and with the phase delay of far radiation field. This means that the effective wavelength in the waveguide is shortened by the slot coupling and thus the beam tilt angle is increased by α. When the number of slots is small as in the present antenna, the perturbation term α in the equation (1) cannot be made negligible. For example, when the number of slots is 14, the perturbation term α becomes about 12 degrees. Accordingly, the tilt angle necessary for reception of satellite broadcasting waves in Japanese territory is 52 degrees, it is necessary to determine the wide wall width ar in accordance with the equation (2) in such a manner that the first term of the equation (1) has a value of 40 degrees.

An offset of the crossed slot from the axis of the waveguide is selected so that the reflection of the single waveguide and the axial ratio of radiation waves in the tilt angle direction are simultaneously minimized. When the shape of the antenna is optimized by minimizing only the axial ratio, the reflection is also automatically suppressed. This is already explained in the document (5). The optimizing design is conducted based on electromagnetic analysis. As mentioned above, since the number of slots is small, coupling per slot is strong. With respect to the operation of leaky waves, in order to suppress side lobe, it is necessary to minimize the interval between the slots, which results in that mutual coupling between the slots becomes strong. Accordingly, as far as electromagnetic field analysis is concerned, analysis of all waves is carried out taking into consideration the mutual coupling of all the crossed slots arranged on the single radiation waveguide.

Figure 2:
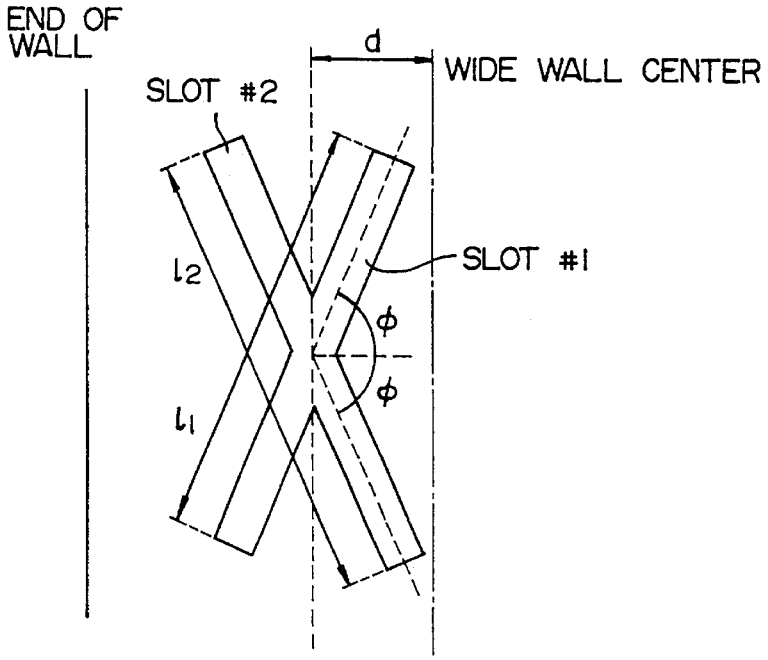
FIG. 2 is a diagram for explaining the shape of a crossed slot and associated design parameters.

Design parameters associated with the crossed slot include, as shown in FIG. 2, lengths $L_1$ and $L_2$ of two slots #1 and #2 of a crossed slot, an intersection angle ϕ between the slots, an offset d of the slot intersection from the center of the waveguide, and an interval p between adjacent crossed slots.

With the slotted leaky waveguide array antenna, optimization of the respective design parameters is usually carried out by a computer simulation. An all-wave analysis using a moment method is utilized as an analysis model for the simulation. For details of this analysis method, refer to the literature (17) when necessary.

In the case of the slotted leaky waveguide array antenna, since an average interval of the respective elements (crossed slots) is as small as about 0.45λo, external mutual action cannot be made negligible. Accordingly, it becomes necessary to correctly evaluate the external mutual coupling between the elements on the same radiation waveguide and to reflect it on the design. In the slotted leaky waveguide array antenna, an analysis method for obtaining a desired beam peak direction (tilt angle) taking the slot coupling into consideration, is explained in the aforementioned literature (16).

The slotted leaky waveguide array antenna is designed in the following procedure, as explained in the literature (18).

(1) The size of the waveguide is set in such a range as to allow realization of a desired beam peak direction.

(2) An offset of a crossed slot is determined so that both of the axial ratio and reflection of electromagnetic waves radiated from the crossed slot become substantially minimum in the case of the formation of a single crossed slot with respect to the waveguide size already set in the above Paragraph (1). The above determined offset is set for all of a plurality of crossed slots to be formed.

(3) Initial values are set for the lengths $L_1$ and $L_2$ of each crossed slot, the intersection angle ϕ and the interval p between the crossed slots, in order to realize a substantially uniform aperture amplitude.

(4) Through the all wave analysis with use of the above set parameters, one of the crossed slots which radiates waves with the worst axial ratio is detected. With respect to the detected crossed slot, the all wave analysis is repetitively carried out until the axial ratio of the radiation waves becomes minimum, whereby the length $L_2$ and the intersection angle ϕ are corrected.

(5) The correction in the above Paragraph (4) is repeated until the axial ratios of waves radiated from the respective crossed slots becomes smaller than a predetermined level.

With the slotted leaky waveguide array antenna of the optimum configuration determined by the above design method, such an offset is set that, when a single crossed slot is formed in each the radiation waveguides, both of the axial ratio and reflection of waves radiated from the crossed slot are substantially minimum, and the intersection angle between two slots in each crossed slot is generally monotonously increased along the propagation direction of the radiation waves.

The beam peak direction, when the slot coupling is ignored, has a theoretical value ($\sin^{-1}(\lambda o/\lambda g)$) determined by the leaky wave principle. However, the actual beam peak direction becomes larger than the above value due to the slot coupling. Thus, in accordance with the present invention, the wide wall width of the waveguide for realization of a desired beam peak direction is set within a range where a value smaller than a beam tilt angle calculated based on accurate analysis taking also a phase change δ into consideration is realized.

In accordance with the present method, in order to minimize design parameters to be optimized, the common offset d to all the crossed slots is set. Further, from the viewpoint of minimizing the design parameters to be optimized, the crossed slot interval p and the length $L_1$ of each crossed slot are basically not changed after their initial values are determined, and only the length $L_2$ and intersection angle ϕ are corrected and the all wave analysis is repeated until the axial ratios of all the crossed slots becomes smaller than a predetermined value.

In the present method, the offset d is determined so that both of the axial ratio of the single crossed slot in the beam peak direction (which will be referred to merely as the axial ratio, in the present specification) and the reflection are simultaneously minimized. As a result, at the time of optimizing the design parameters thereafter, when the design parameters are modified merely so as to minimize the axial ratio of the single crossed slot, the reflection is also automatically minimized (suppressed). In the case of the crossed-slot leaky waveguide array antenna, the reflected wave causes circular polarized waves of left turn to be radiated in a direction opposite to the beam peak direction. This also holds true not only for the crossed-slot leaky waveguide array antenna but also for general waveguide slot array antennas. When beam tilting is effected in such a condition that respective elements cause reflection, reflection at the feed point can be suppressed. However, since reflection is present between the elements, complicated design to take it into account is required. Accordingly, when optimization of the axial ratio or suppression of the reflection for each crossed slot (element) is employed as in the present invention, the design can be carried out sequentially from the side of the terminating end of the leaky waveguide, which results in the design being remarkably simplified.

Figure 3:
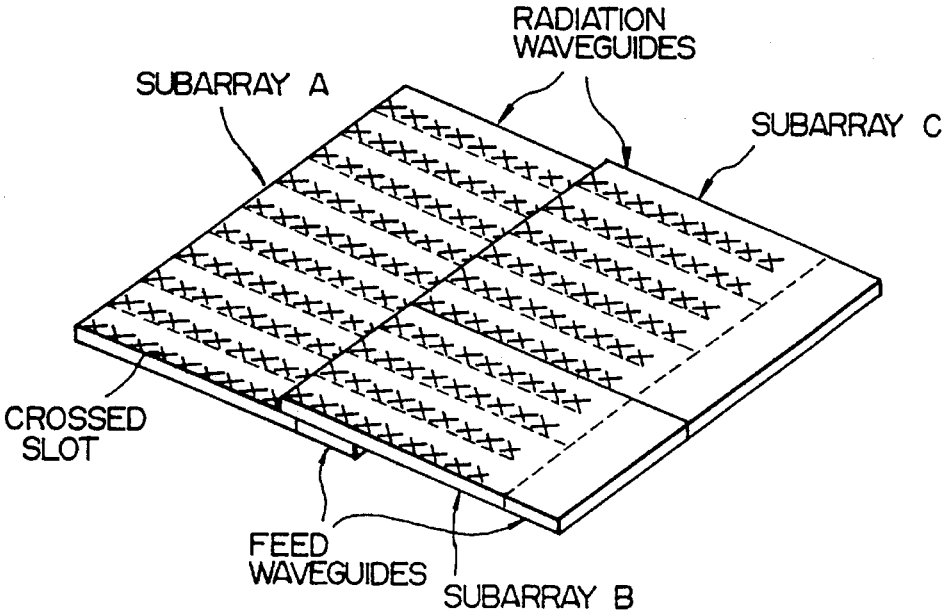
FIG. 3 is a perspective view showing an example in which the slotted leaky waveguide array antenna of the present invention is applied to an antenna of a direct broadcasting satellite (DBS) type for reception of satellite broadcasting waves.

One of the slotted leaky waveguide array antennas subjected to the optimization design is, for example, a DBS signal reception antenna which is designed to be mounted on a vehicle and which comprises three subarrays A, B and C as shown in FIG. 3. Each of the subarrays A, B and C is made up of a radiation waveguide section of a multiplicity of leaky waveguides which are provided therein with a multiplicity of crossed slots in the propagation direction of the radiation wave and which are arranged parallel to each other and also made up of a feed waveguide section through which radiation wave is supplied to the radiation waveguide section. The optimization design is effected with respect to any one of the leaky waveguides and the obtained optimum design values are set even for the other leaky waveguides.

Each of the leaky waveguides is provided therein with 15 crossed slots. Each time the design parameters are changed (modified), the all wave analysis (moment method) is repeated taking external mutual action between all the crossed slots into consideration. The design target is to make the excitation amplitudes of the respective crossed slots equal and to minimize the axial ratio in the tilt direction. At this time, since the offset is correctly set, the reflection from the respective element and the reflection to the feed point are suppressed. In this case, it is assumed that the terminating end is matched.

Determining the Wide Wall Width of the Waveguide

It is assumed that the present invention is applied to such a DBS signal reception antenna as shown in FIG. 3 and that a center frequency is 11.85 GHz and a desired beam peak direction is 52 degrees. A wide wall width for obtaining the final beam peak direction of 52 degrees was determined to be 17.2 mm that realizes a beam peak direction of 42.5 degrees smaller by about 10 degrees than the above 52 degrees based on the leaky wave principle. Further, a narrow wall width was set to be 4.0 mm.

Determining the Offset d

Figure 4:
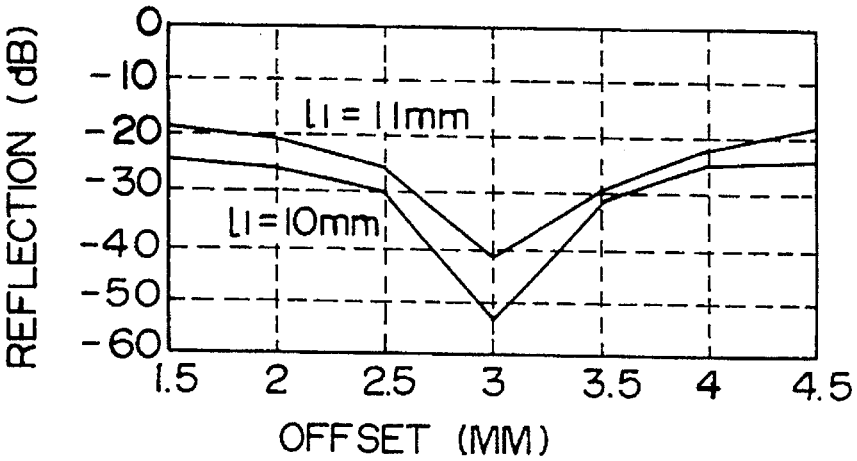
FIG. 4 is a graph showing relationships between reflection and offset at a crossed slot optimized to provide a minimum axial ratio.

A single crossed slot is formed in a waveguide and the length $L_2$ of slot #2 in the crossed slot and the mutual intersection angle $\phi$ are optimized with respect to the length $L_1$ of slot #1 in the crossed slot, so that the axial ratio of electromagnetic waves radiated from the crossed slot becomes minimum. The reflection in this case is shown in FIG. 4. It will be seen from the chart that, even when the slot length $L_1$ varies in a range between 10 mm and 11 mm in minimum, the reflection becomes minimum at the offset d of 3.0 mm. Thus, in the present design, the offset d is set to be 3.0 mm.

Setting the Initial Values of Design Parameters for Each Crossed Slot

Figure 5:
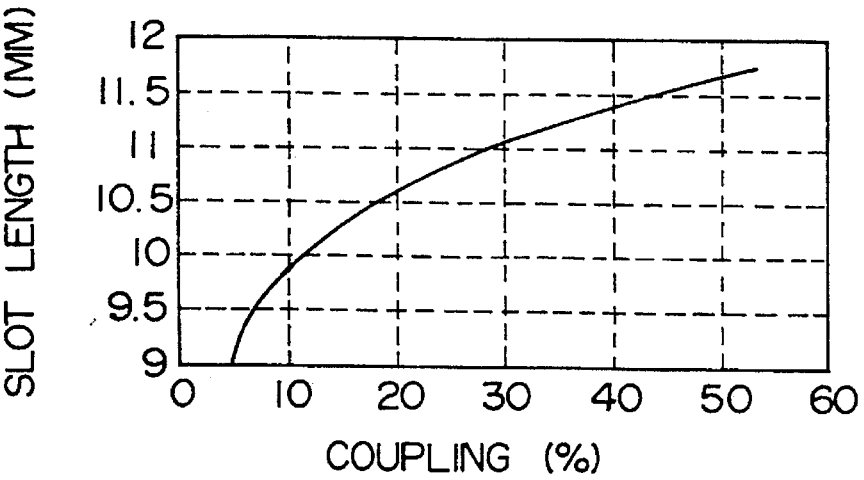
FIG. 5 is a graph showing a relationship between slot length and coupling degree.

In order to realize a uniform aperture amplitude along the propagation direction of radiation electromagnetic wave, it is necessary to gradually increase the slot length in a direction pointing from the start end of the leaky wave waveguide toward an end thereof. In particular, after the initial value of the length $L_1$ of one slot #1 is determined, the length $L_1$ is not changed (modified), so that the determination of this initial value determines the uniformity of the final aperture amplitude. The initial value of the length $L_1$ used in the present design is determined as follows;

(1) A single crossed slot is formed in the leaky wave waveguide and the length $L_2$ of slot #2 of the crossed slot and the intersection angle $\phi$ are optimized so that the axial ratio (reflection) becomes minimum with respect to the length $L_1$ of slot #1 of the crossed slot. A variation in the slot length $L_1$ to the coupling C (=radiation power/incident power) is shown in FIG. 5.

(2) In order to realize a uniform aperture amplitude for an N-element array, the coupling C(n) of the elements n (n=1 for the input side and n=N for the terminating end side) is determined so as to satisfy the following asymptotic formula.

$$C(n-1)=C(n)/[1+C(n)]$$

$$(n=N, N-1, \ldots, 3, 2)$$

When the coupling C(N) of the crossed slot at the terminating end side is given, the couplings C(n) of the respective crossed slots are determined sequentially from the terminating end side in accordance with the above asymptotic formula. Accordingly, lengths $L_1$ (n) of the respective crossed slots are determined sequentially from the terminating end side on the basis of a relationship between length $L_1$ and coupling C shown in FIG. 4.

(3) The length $L_2(n)$ of slot #2 of each crossed slot and the intersection angle $\phi(n)$ are determined so that the axial ratio of electromagnetic wave radiated from each crossed slot becomes minimum. Further, a crossed slot interval p(n) is set to be $L_2(n)+1$ so as not to be overlapped with an adjacent crossed slot. The crossed slot interval p(n), after determined as its initial value, is not changed (modified).

Changing Parameters Based on All Wave Analysis

After the initial values of the design parameters of each crossed slot are set, the all wave analysis is carried out. With use of the found excitation amplitude and phase of each crossed slot, the axial ratio of the associated crossed slot is calculated. Such calculation is carried out for all the crossed slots. One of all the crossed slots which axial ratio is the worst is selected and the all wave analysis is repeated by changing the associated slot length $L_2$ and intersection angle $\phi$until the axial ratio of the selected crossed slot becomes minimum. A unit change in the variation of each parameter is set as follows. For example, a unit change in the slot length $L_2$ was set to be 0.1 mm and a unit change in the intersection angle $\phi$ was set to be 1 degree. the axial ratios of the respective crossed slots are repetitively minimized until the axial ratios of all the crossed slots become below 1 dB.

Design Results

Figure 6A:
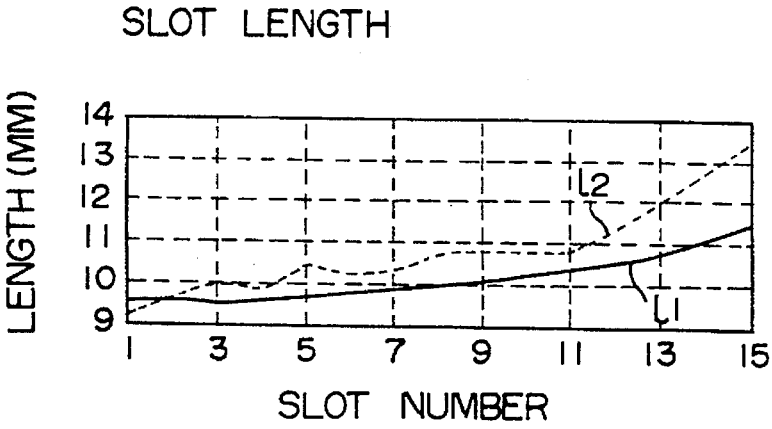
FIG. 6A is a graph showing relationships between slot position and optimum slot length for different crossed slots.
Figure 6B:
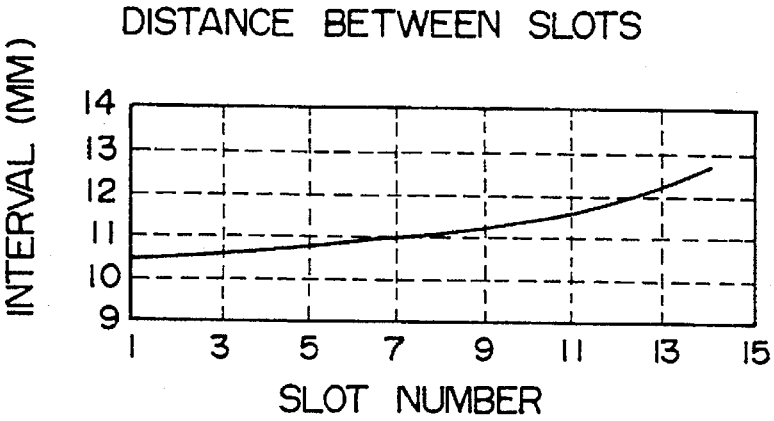
FIG. 6B is a graph showing a relationship between the slot position and optimum inter-slot distance for each crossed slot.
Figure 6C:
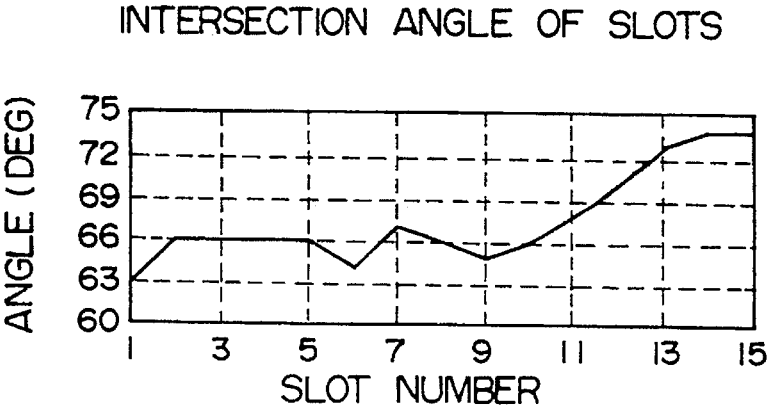
FIG. 6C is a graph showing a relationship between the slot position and optimum slot intersection angle for each crossed slot.

The values of the design parameters of the crossed slots finally determined according to the aforementioned design are shown in FIGS. 6A, 6B and 6C. It will be seen from the drawings that, as the crossed slot goes from the starting end to terminating end of the leaky wave waveguides, the slot lengths $L_1$, $L_2$, intersection angle $\phi$ and crossed slot interval p are all increased. For the purpose of improving the uniformity of the excitation amplitude, with respect to two (n=1, 2) of the crossed slots at the start end side, the slot lengths $L_1(1)$ and $L_1(2)$ are set to be 0.1 mm longer than their initial values.

Figure 7A:
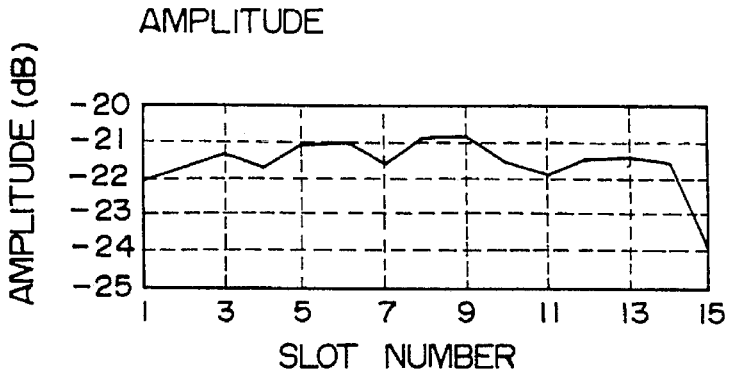
FIG. 7A is a graph showing an amplitude characteristic of each crossed slot.
Figure 7B:
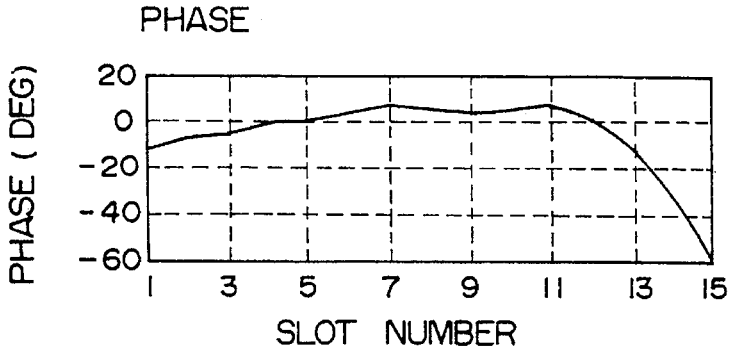
FIG. 7B is a graph showing a phase characteristic of each crossed slot.
Figure 7C:
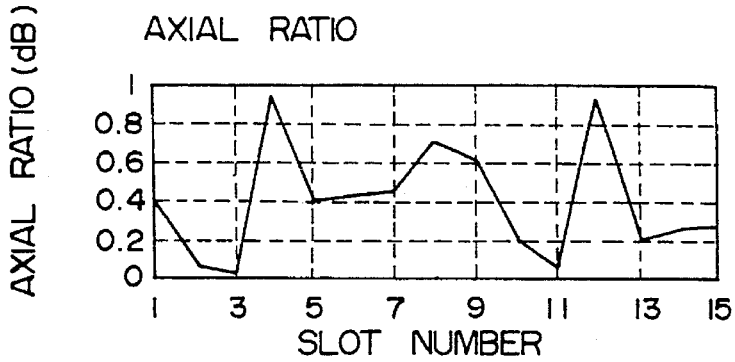
FIG. 7C is a graph showing an axial ratio characteristic of each crossed slot.
Figure 7D:
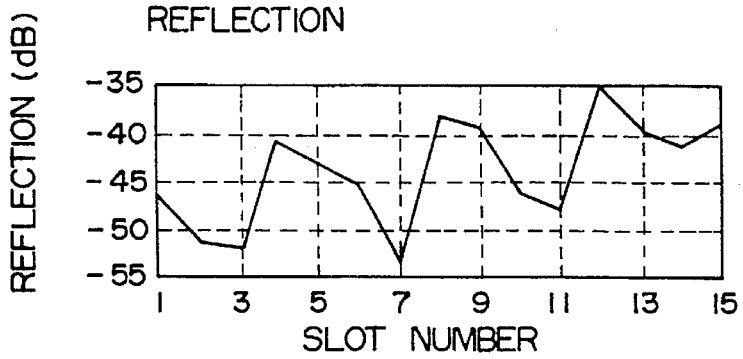
FIG. 7D is a graph showing a reflection characteristic of each crossed slot.

FIGS. 7A, 7B, 7C and 7D show excitation characteristics of the crossed slots. More in detail, A phase distribution shown in FIG. 7B is measured from the beam peak direction (52 degrees). Referring to FIG. 7A, the excitation amplitudes of the crossed slots are substantially uniform with a deviation of about 1 dB except for the crossed slot (N=15) at the terminating end. In FIG. 7B, the excitation phase of tree crossed slots at the terminating end side abruptly varies, which leads to the fact that the final beam peak angle becomes larger than the value determined by the leak wave principle. It will be appreciated from the comparison between FIGS. 7C and 7D that the tendency of the axial ratios of the crossed slots substantially coincide with the tendency of the reflections of the crossed slots. Accordingly, when the worst value of the axial ratios of the crossed slots is set to be smaller than 1 dB, it is considered that ripple in the excitation amplitude can also be reduced as shown in FIG. 7A.

Figure 8A:
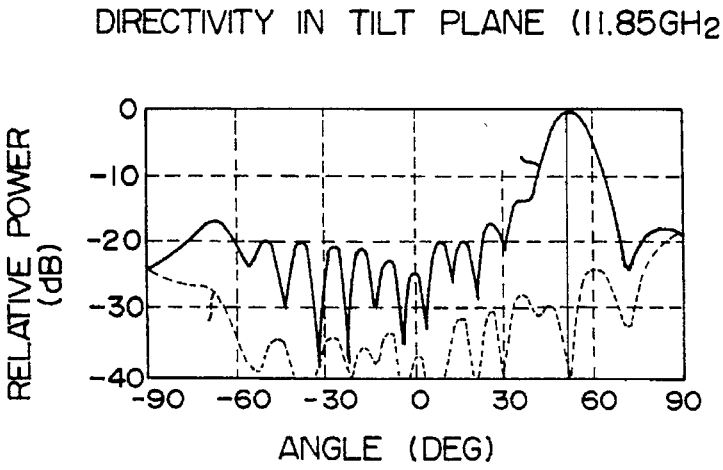
FIG. 8A is a graph showing an in-tilt-plane directivity of a slotted leaky waveguide array antenna of the present invention obtained through an optimum design.
Figure 8B:
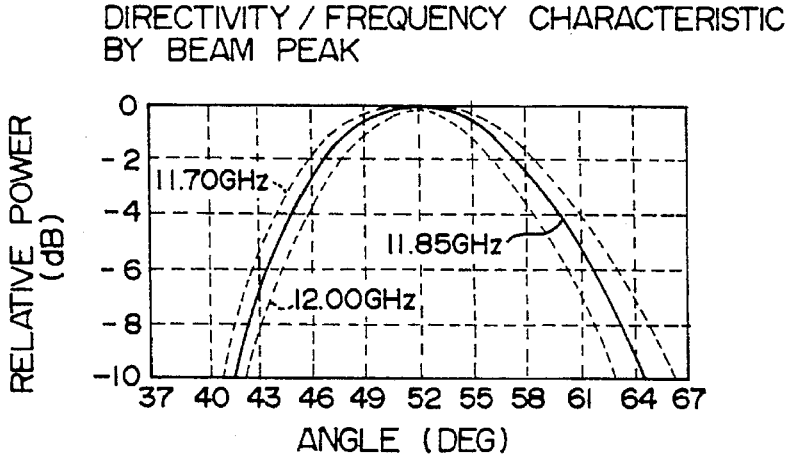
FIG. 8B is a graph showing directivities of the slotted leaky waveguide array antenna of the present invention in the vicinity of a beam peak.
Figure 8C:
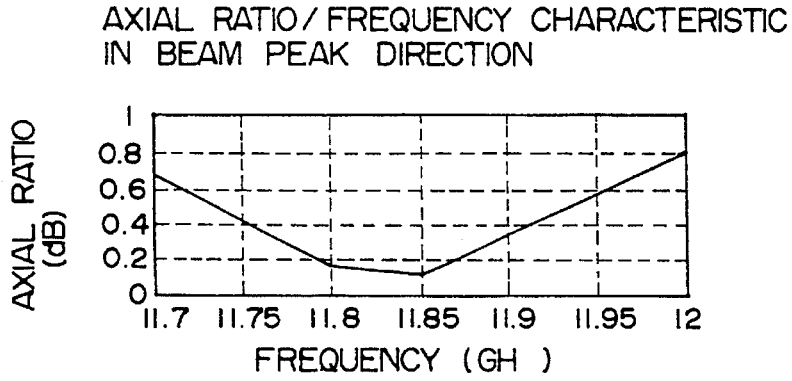
FIG. 8C is a graph showing an axial-ratio/frequency characteristic for electromagnetic wave in a beam peak direction of the slotted leaky waveguide array antenna of the present invention.

Shown in FIGS. 8A, 8B and 8C are directivity characteristics of an array antenna having a single leaky wave waveguide. More specifically, referring to FIG. 8A, it will be seen that the main beam is directed in a desired 52-degree direction and at the 52 degrees, a cross polarization component is suppressed. The side lobe of a wide angle region is as somewhat high as −17 dB, but when the elements are arranged more closely adjacent to each other, the side lobe can be further suppressed. FIG. 8B shows in normalized units a directivity in the vicinity of the beam peak direction with respect to a center frequency of 11.85 GHz and with respect to frequencies (12.00 and 11.70 GHz) spaced higher or lower therefrom by 0.15 GHz. It will be seen from the drawing that, when a value 6 dB lower than the peak gain for example is allowed as the receivable lowest gain, an elevation range of about 16 degrees can be covered in the BS band. As shown in FIG. 8C, the axial ration in the beam peak direction is kept to be below 0.8 dB throughout the entire BS band.

Figure 9A:
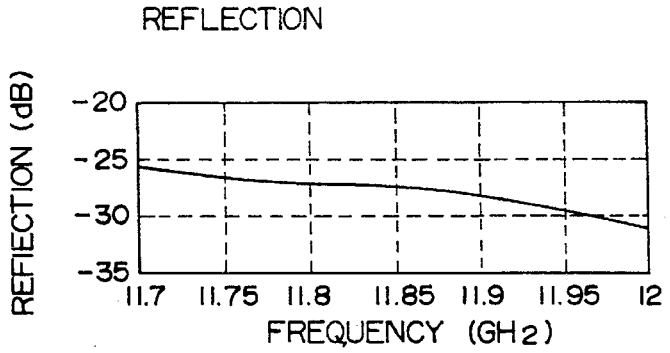
FIG. 9A is a graph showing a reflection/frequency characteristic of the slotted leaky waveguide array antenna of the present invention.
Figure 9B:
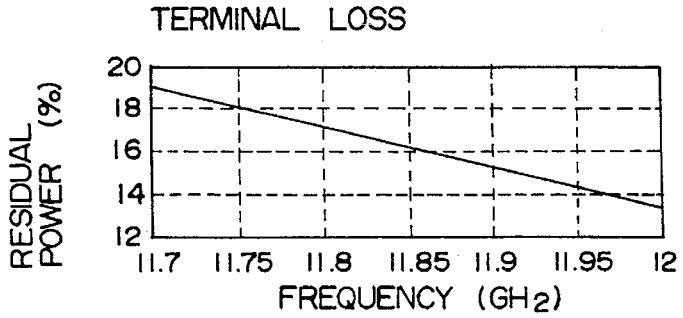
FIG. 9B is a graph showing a terminal loss/frequency characteristic of the slotted leaky waveguide array antenna of the present invention.

FIGS. 9A and 9B show reflection/transmission characteristics of the entire array antenna. It will be seen from the drawings that the reflection is suppressed to be below −25 dB and the terminal loss is also suppressed to be below 20% throughout the entire BS band.

Although an interval between the center of the wide wall and the center of the crossed slot is defined as the offset, an interval between one end of the wide wall and the center of the crossed slot may be defined as the offset.

Further, the present method has been explained in connection with the case where the invention is applied to the antenna for reception of satellite broadcasting waves and designed for mounting on a vehicle, but it goes without saying that the present invention can be applied to an antenna of an fixed installation type for reception of satellite broadcasting waves. Furthermore, the present invention is not limited to an antenna designed for receiving satellite broadcasting waves but may be applied also to a transmitting/receiving antenna.

In this way, paying attention to the excitation amplitude and axial ratio of each slot, the lengths of the two slots and the intersection angle therebetween are adjusted to optimize the shape of the crossed slot. The relationship between the number of crossed slots formed in the radiation waveguide and the beam width in the tilt angle direction is evaluated based on the gain calculation. The conditions (1) to (3) of the gain calculation are:

(1) Excitation is carried out so that the amplitude of the crossed slots is uniform and the phase is aligned to the tilt direction.

(2) The inter-slot phase of the same crossed slot is provided so that waves are perfect circular polarized waves of right turn in the tilt direction.

(3) An antenna efficiency is 70%.

Figure 10:
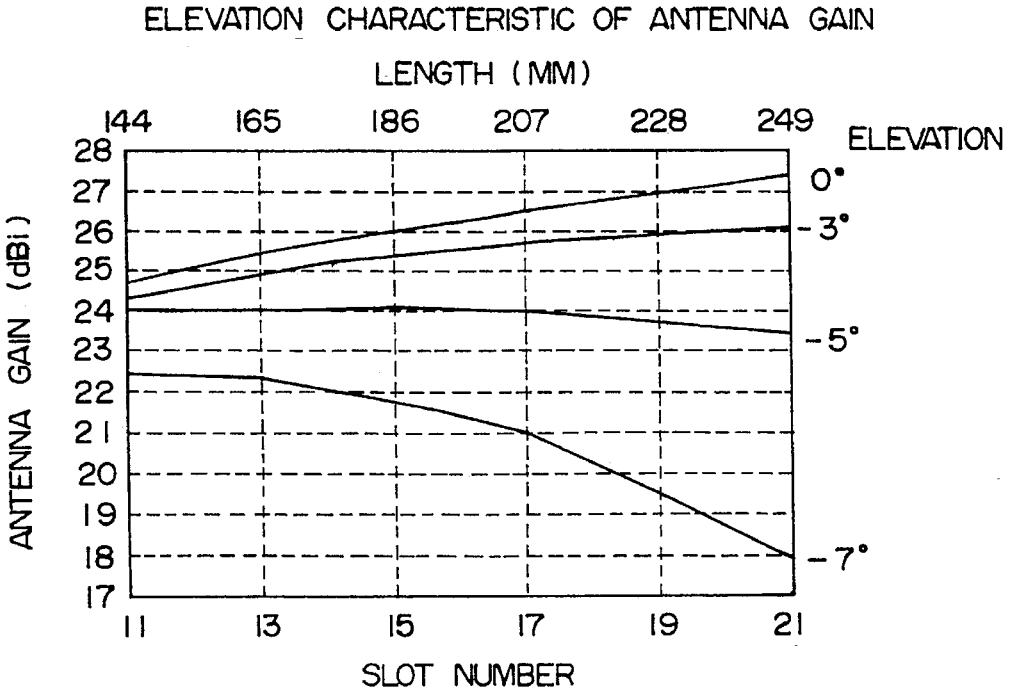
FIG. 10 is a graph showing an antenna gain characteristic of the slotted leaky waveguide array antenna of the invention with respect to the slot number and elevational angle.

FIG. 10 shows variations in gain in different directions different by 3, 5 and 7 degrees (correspond to the road slope angles) from the main beam (peak) when the number of radiation waveguides is 16 and the number of crossed slots per radiation waveguide is varied. An interval between the radiation waveguides was set at 18.5 mm, an interval between the crossed slots formed in each radiation waveguide was at 10.4 mm, a center value (center frequency) of received frequencies was at 11.85 GHz, and a main beam was directed at 52.0 degrees. In this case, the feed waveguide 2 has a length of 296 mm. radiation waveguide length values given in the upper part of FIG. 10 are estimated or approximate values found when the feed waveguide 2 having no slot has a width of 30 mm. Further, when the number of radiation waveguides is changed, the entire graph of FIG. 10 is shifted upward or downward in proportion to the change in radiation waveguide number. For example, when the number of radiation waveguides is changed from 16 to 12, the gain in the ordinate axis of FIG. 10 is decreased by 1.25 dB (=12/16).

When the number of crossed slots formed in each radiation waveguide is increased, this causes the area of the antenna to be increased, so that the antenna gain also monotonously increases. The gain in a direction shifted by 3 degrees from the main beam direction also slowly increases with the increase of the number of crossed slots. However, the gain in a direction shifted by 5 degrees from the main beam direction is constant even when the number of crossed slots is increased to 17; whereas, in a crossed slot number range of 18 or more, the gain slowly increased with the increase of the crossed slot number. Further, the gain in a direction shifted by 7 degrees from the main beam direction is substantially constant in a crossed slot number range of 13 or less; whereas, in a crossed slot number range of 14 or more, the gain decreases with the increase of the crossed slot number.

When the number of crossed slots is increased, the peak gain can be raised, but the width of the main beam becomes narrow and thus it becomes impossible to employ the non-tracking system to the elevational direction. When the number of crossed slots is decreased to the contrary, the main beam width can be made wide, but the peak gain is decreased and thus the antenna cannot cope with a drop in the level of the received signal in rainy days. When the necessary beam width in the main beam direction is estimated to be about ±5 degrees capable of handling the typical slope of a road, an optimum range for the number of crossed slots is 15± about 2. When a necessary minimum C/N is estimated to be 8 dB and an antenna gain necessary for obtaining this C/N is to be 24 dBi, the minimum number of radiation waveguides necessary for realizing a beam width of ±5 degrees is 16. When it is desired to arrange a signal receiving antenna which is designed for being mounted on an automotive vehicle and small in size and in thickness and economical, it is considered to combine it with a liquid crystal television with unnoticeable noise. In this case, the necessary antenna gain becomes low and the number of radiation waveguides can be reduced to 15 or less.

Figure 11:
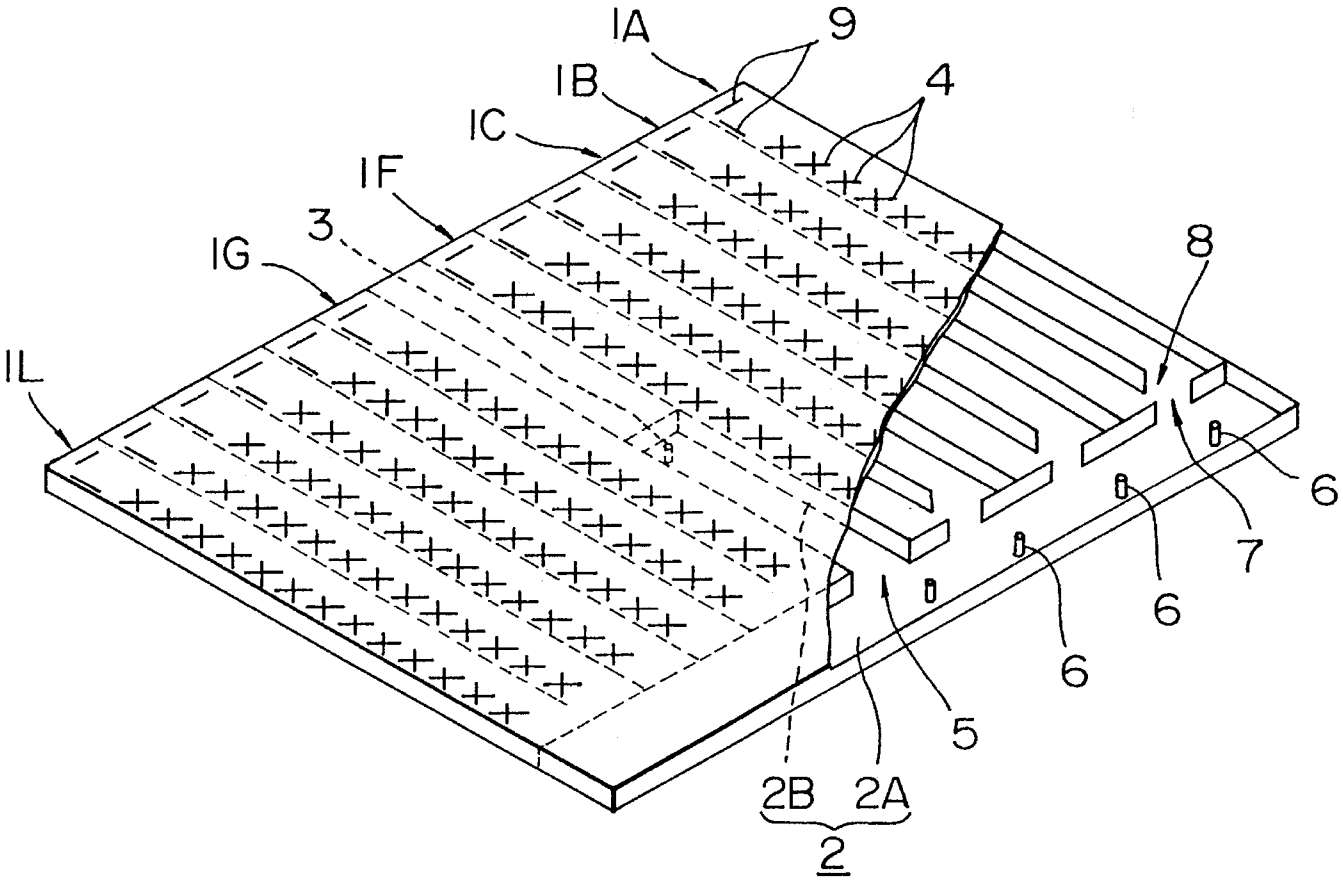
FIG. 11 is a perspective view of an arrangement of a slotted leaky waveguide array antenna in accordance with another embodiment of the present invention.

FIG. 11 is a perspective view of an arrangement of a slotted leaky waveguide array antenna in accordance with another embodiment of the present invention. In FIG. 11, constituent elements having the same functions as those in FIG. 1 are denoted by the same reference numerals, and explanation thereof is omitted. The antenna of the present embodiment is different from that of FIG. 1 in the structure of the feed waveguide 2. More in detail, the feed waveguide 2 comprises a first part 2A extended along one end of the radiation waveguides 1A to 1L as well as a second part 2B extended between the radiation waveguides 1F and 1G from the feed probe 3 disposed at the rotary center of the antenna to the center of the first part 2A. The center part of the first part 2A of the feed waveguide 2 is coupled to one end of the second part 2B to form a T junction.

Electromagnetic waves received at the radiation waveguides are propagated through the first part 1A of the feed waveguides from the T junction at the center of the feed waveguides into the second part 2B, and further supplied through the feed probe 3 provided at one end of the second part 2B to a converter position downstream the antenna. In this way, when such a center power supply type is employed that the feed probe 3 is provided at the rotary center for following up the directional angle of the antenna, only the antenna can be rotated with the converter connected to the feed probe 3 being fixed.

Figure 12:
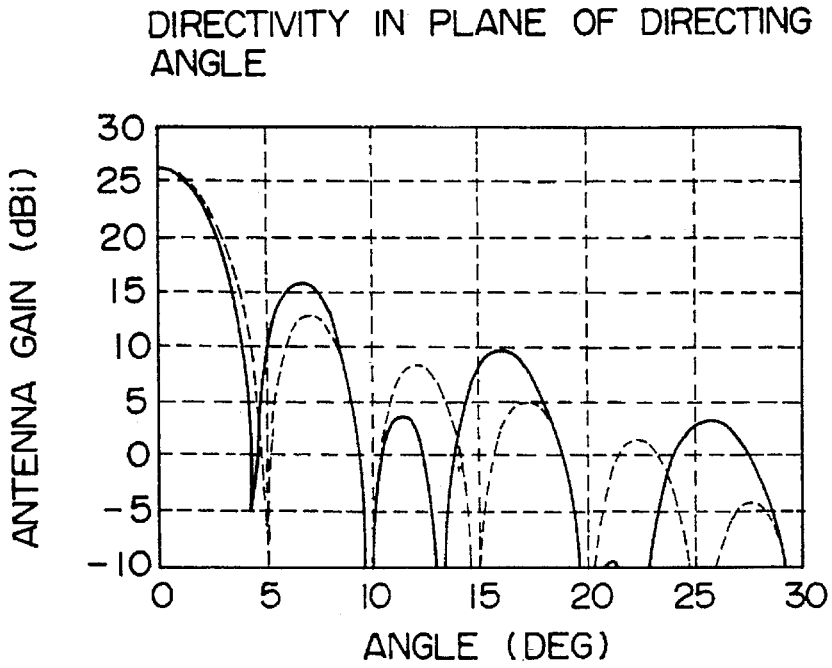
FIG. 12 is a graph showing directivities of in-planes in an azimuth direction when a second part is provided to a feed waveguide for comparison with no provision of the second part thereto.

With the antenna of FIG. 11, since the second part 2B of the feed waveguide 2 is provided in the center of the antenna, there is formed a blank area where crossed slots are not present along a width corresponding to one radiation waveguide. Therefore, the level of side lobe in the plane of the azimuth direction is expected to increase. In order to confirm the influences of the blank area on the directivity of the azimuth direction, calculation was carried out with respect to directivities when the blank area is absent and present with use of 16 of the radiation waveguides. The calculation results are given in FIG. 12. In the drawing, a solid line indicates the directivity in the presence of the blank area, while a dotted line indicates the directivity in the absence of the blank area. In the presence of the blank area, the main beam becomes narrow because the antenna area is increased. The level of a first side lobe is increased to −11 dB with respect to the peak level of the main beam. For this reason, regardless of the fact that the antenna area is increased, the peak gain is not substantially increased. The level of side lobe in the azimuth range of 30 degrees or more is suppressed to below −40 dB with respect to the peak level of the main beam.

In this way, when the antenna of the present invention is arranged to be of a center power feed type, it becomes somewhat disadvantageous from the viewpoint of its electrical characteristics but also advantageous in that only the antenna can be rotated on the feed probe 3 with the converter being fixed.

Two types of slotted leaky waveguide array antennas were made on an experimental basis. In one type of slotted leaky waveguide array antenna, each of radiation waveguides is provided therein with 12 crossed slots and a matching slot pair is formed in the terminating end thereof. Such a slotted leaky waveguide array antenna will be referred to as M type, hereinafter. In the other type of slotted leaky waveguide array antenna, each of radiation waveguides is provided therein with 14 crossed slots and a terminating end thereof is merely short-circuited. Such a slotted leaky waveguide array antenna will be referred to as S type, hereinafter. In either type, any electromagnetic-wave absorber is not used. The both types of antennas have such parameters as shown in Table below.

TABLE

| | |
|---|---|
| Radiation waveguide wide wall width | 16.5 mm |
| Feed waveguide wide wall width | 17.3 mm |
| Waveguide thickness | 4.0 mm |
| Number of radiation waveguides | 12 |
| Slot offset | 2.8 mm |
| Slot length range | 10.5–12.5 mm |
| Slot intersection angle range | 113–120 degrees |
| π-junction coupling window width range | 11.5–12.5 mm |
| π-junction notch length range | 9.0–10.0 mm |
| Antenna size | 225 × 195 mm |
| Aperture face size | 225 × 155 mm |
| Design frequency | 11.85 GHz |
| Beam peak direction | 52.0 degrees |

Aperture Face Distribution

Figure 13:
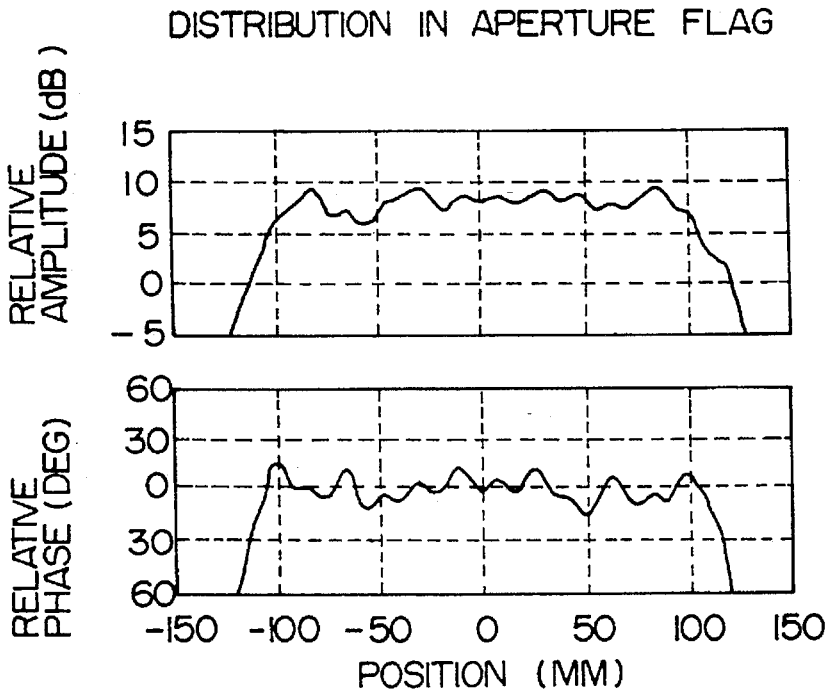
FIG. 13 show distributions of amplitude and phase of an S type of slotted leaky waveguide array antenna of the present invention in an in-open-plane scanned parallel to the feed waveguide.

FIG. 13 shows results of a scanning operation when the S type antenna was subjected to the scanning operation parallel to the feed waveguides at a design frequency. This aperture face distribution indicates the quality of the distribution characteristic of the feed waveguides. The charts confirmed that a uniform amplitude distribution and a uniform phase distribution were realized and the feed waveguides perform their traveling-wave operation according to the design.

Reflection Characteristic

Figure 14:
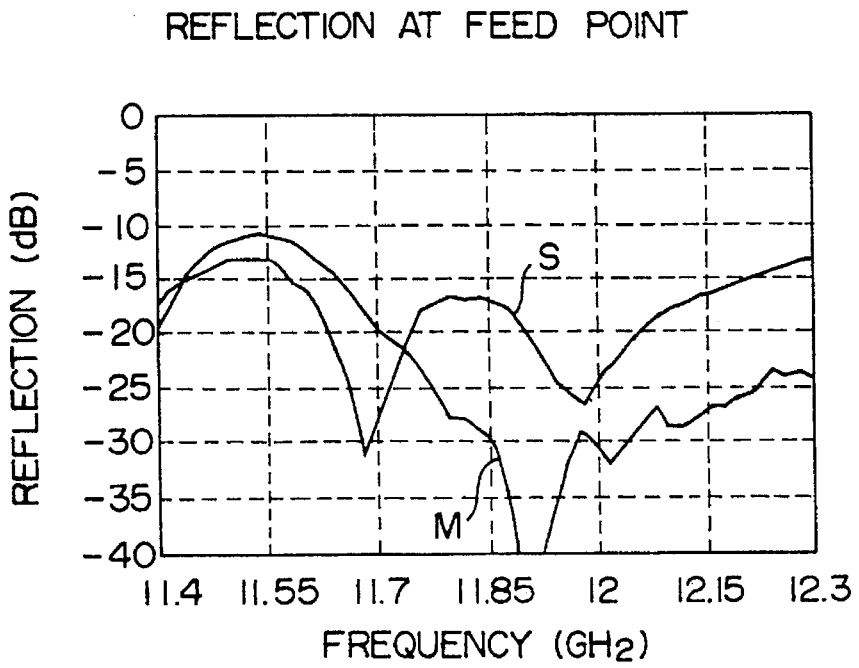
FIG. 14 is a graph showing relationships between reflection at a feed point and electromagnetic wave frequency with respect to the S and M types of slotted leaky waveguide array antennas of the present invention.

FIG. 14 shows a reflection/frequency characteristic at the feed point. It will be seen from the chart that the M and S types of antennas have both a sufficiently small reflection in the BS band (between 11.7 and 12.0 GHz). In a range above the BS band, the reflection of the M type of antenna is smaller than that of the S type of antenna. It is considered in the M type of antenna that the matching slot pair formed at the terminating end of the radiation waveguides acts to sufficiently suppress the reflection from the terminating end.

Directivity in Tilt Plane

Figure 15A:
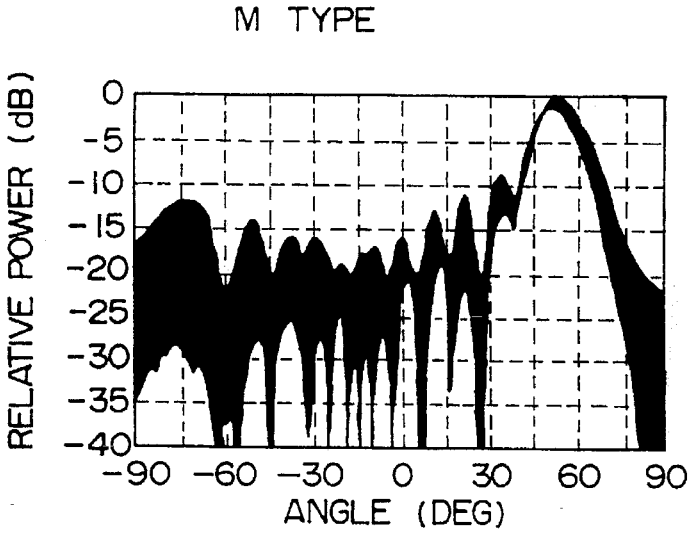
FIG. 15A is a graph showing a Fresnel directivity characteristic of an M type slotted leaky waveguide array antenna of the present invention in an tilt plane.
Figure 15B:
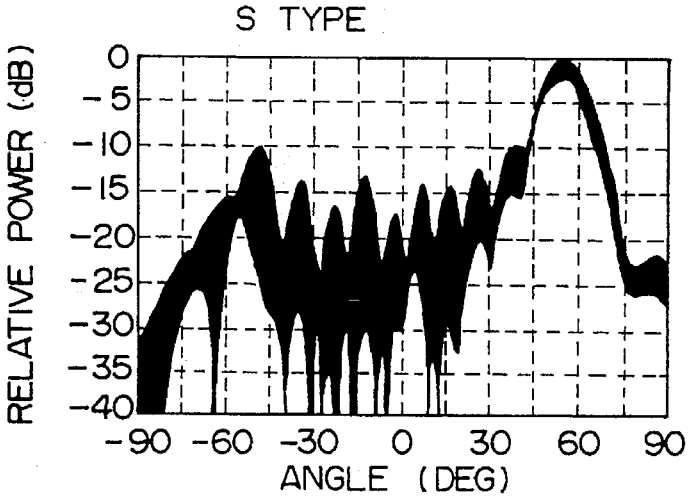
FIG. 15B is a graph showing a Fresnel directivity characteristic of an S type slotted leaky waveguide array antenna of the present invention in an tilt plane.
Figure 15C:
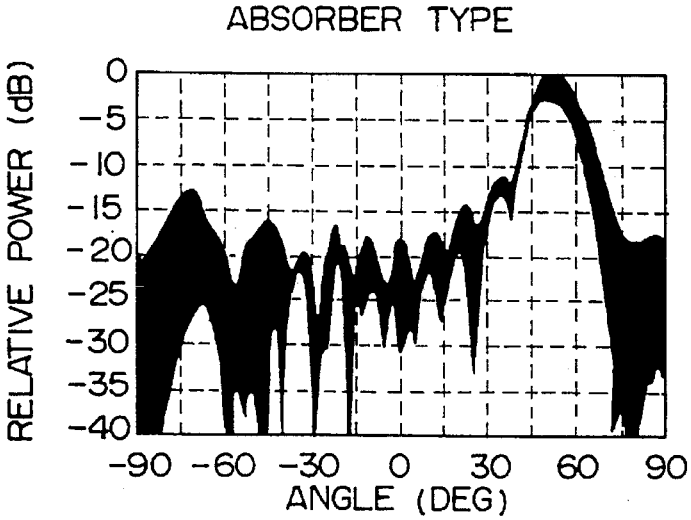
FIG. 15C is a graph showing a Fresnel directivity characteristic of a slotted leaky waveguide array antenna of an absorber type in an tilt plane.

FIGS. 15A, 15B and 15C show Fresnel directivity characteristics in the tilt plane when measured at a design frequency. The beam peak direction (circular polarized wave component of right turn plus circular polarized wave component of left turn) in a spin linear pattern was 53.5 degrees for both of the M and S types. Accordingly, as already explained in connection with the equation (1), it is seen that the perturbation part $\alpha$ of the beam tilt angle due to the slot coupling is as extremely large as about 13.5 degrees.

The directivity characteristic of the M type antenna (FIG. 15A) is similar to that of the antenna (FIG. 15C) having electromagnetic-wave absorber mounted at the terminating end of the radiation waveguides. However, with the latter absorber type antenna, the axial ratio is deteriorated because the shape parameters of the crossed slots are different. It is considered in the M type antenna that the matching slot is favorably operated and circular polarized waves of right turn are radiated in the tilt angle direction. Further, no increase in the side lobe in a direction of about −50 degrees caused by reflected waves is observed. It is considered that selection of a proper crossed slot offset causes realization of the traveling wave excitation. The axial ratio in the beam peak direction has a favorable value of 1.0 dB. The level of the first side lobe is about −8.5 dB.

On the other hand, in the directivity characteristic (FIG. 15B) of the S type antenna, the level of side lobe in the direction of about −50 degrees is increased to −10 dB. This is considered to be because of the reflection from the terminating end of the radiation waveguides. Further, the axial ratio in the peak direction is deteriorated to be 1.8 dB. This is considered to be because the axial ratio of the crossed slot in the vicinity of the terminating end of the radiation waveguides is remarkably deteriorated due to the reflected waves.

Figure 16A:
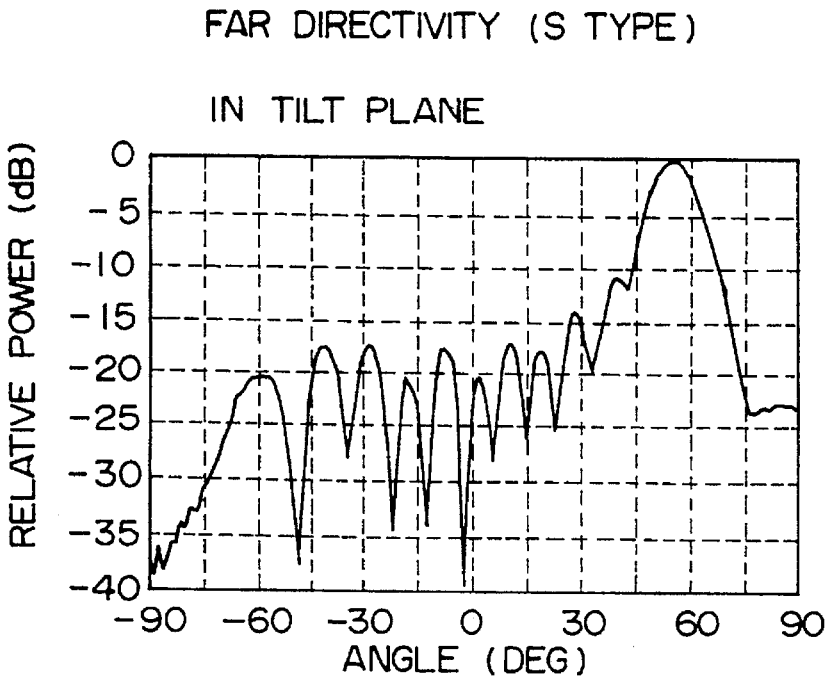
FIG. 16A is a graph showing a far directivity characteristic of the S type slotted leaky waveguide array antenna of the present invention in the tilt plane.
Figure 16B:
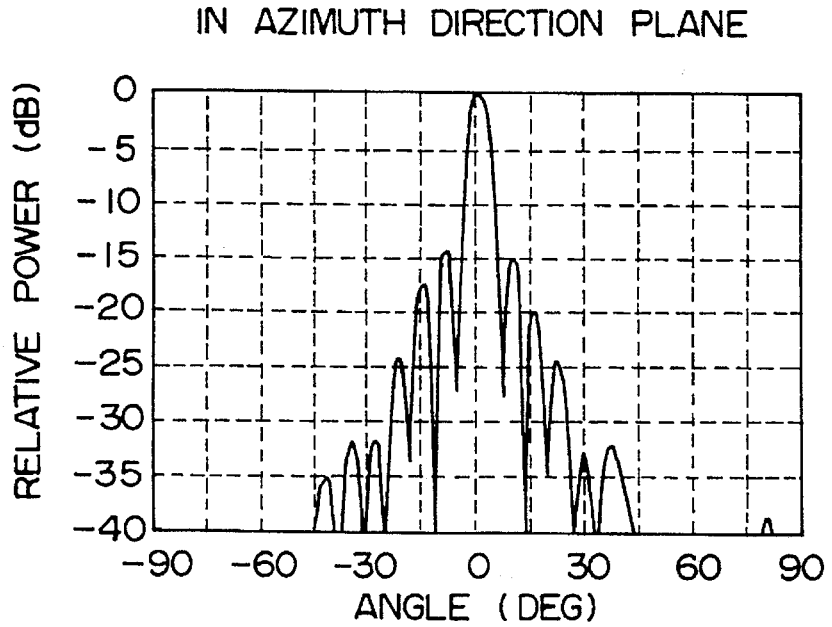
FIG. 16B is a graph showing a far directivity characteristic of the S type slotted leaky waveguide array antenna of the present invention in an tilt plane in an azimuth direction.

FIGS. 16A and 16B show far directivity characteristics of circular polarized waves of right turn of the S type antenna when measured at a design frequency. It will be seen that, as shown in FIG. 16A, a tilt angle of 52 degree conforming to the design value is realized. A level drop in a direction shifted by about 3 degrees from the beam peak direction is about 1.0 dB. As shown in FIG. 16B, in the plane including the directing angle, there is realized such a symmetrical directivity characteristic that side lobe is suppressed, which results from the uniform distribution characteristic of the feed waveguide. A 1-dB-drop beam width is about 3.5 degrees.

Figure 17:
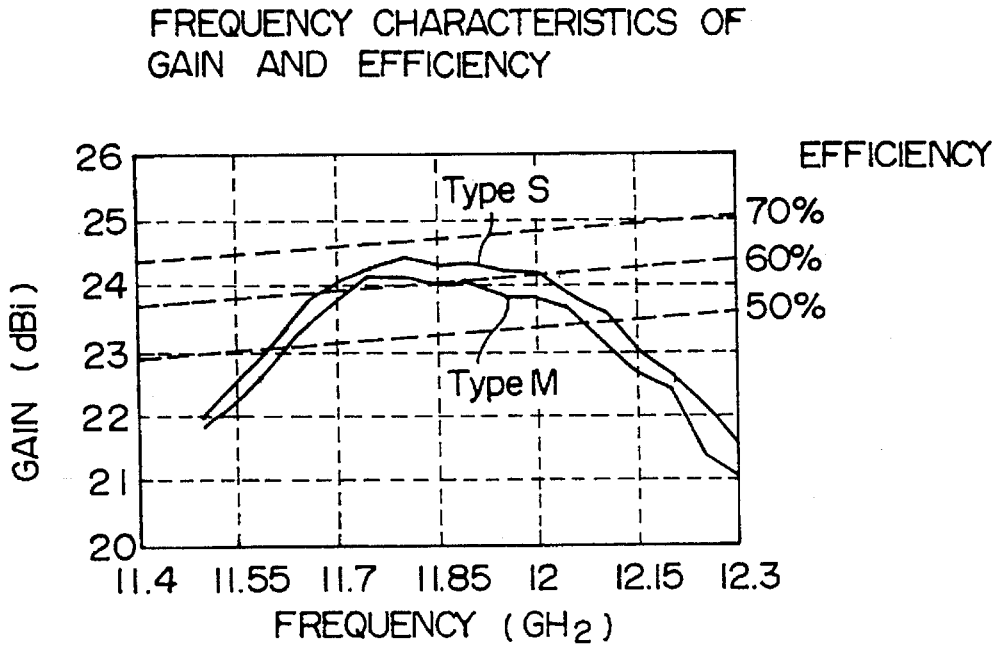
FIG. 17 is a graph showing relationships between gain and efficiency of the S and M type slotted leaky waveguide array antennas of the present invention with respect to frequency.

FIG. 17 shows gain and efficiency characteristics of S and M type antennas when measured with respect to frequency. The efficiency of the S type antenna has a peak value of 66% and is 60% or higher in the BS band. A fluctuation in gain within the BS band is merely about 0.4 dB. The gain of the S type antenna is generally about 0.3 dB higher than that of the M type antenna. As shown in FIGS. 15A and 15B. It is because the level of side lobe in a wide-angle direction (in a range of between −90 and −60 degrees) in the antenna directivity of the S type antenna is lower than that in the M type antenna, as shown in FIGS. 15A and 15B.

Measurement results of C/N ratio for the S type antenna are given in Table below. The antenna has a gain of 24 dBi or more in the BS band and has a C/N ratio of 9.0–9.5 dB. When the present antenna is used for a liquid crystal TV, the user can watch the TV without being bothered with the noise disturbance.

| | Channel 5 | Channel 7 | Channel 11 |
|---|---|---|---|
| S type antenna | 8.8 dB | 9.4 dB | 9.6 dB |
| Reference antenna (Gain: 32.1 dBi) | 16.7 dB | 17.2 dB | 18.0 dB |

As has been explained in detail in the foregoing, in accordance with the slotted leaky waveguide array antenna of the present invention, since the feed waveguide comprises the first part corresponding to the prior art feed waveguide and the second part extended from the center of the antenna to the center of the first part to intersect the first part perpendicularly thereto to thereby form a T junction, the feed section including the feed probe can be disposed in the rotary center of the antenna. Accordingly, only the antenna can be rotated in its horizontal plane while the feed section positioned in the rotary center of the antenna and the converter connected thereto are kept in the stationary state at all times. As a result, the load of the tracking mechanism in the azimuth direction can be lightened to improve its response characteristic, and the vibration and shock applied to the converter can be weakened to realize a high converter reliability.

Further, in accordance with the slotted leaky waveguide array antenna of the present invention, since a desired number of crossed slots each having the identical offset are formed in the respective radiation waveguides, a main beam width of ±5 degrees can be realized for the elevational direction. As a result, since non-tracking system to the elevational direction can be employed, the entire system can be made small in size and the manufacturing cost can be reduced.

What is claimed is:

1. A slotted leaky waveguide array antenna to be connected to a converter, having a rotary center about which said antenna is to be rotated in a substantially horizontal plane for tracking an azimuth direction, said slotted leaky waveguide array antenna comprising:

a plurality of radiation waveguides closely juxtaposed in parallel to each other on a surface plane, each of said plurality of radiation waveguides having a waveguide axis and having a plurality of slots arranged in a direction of said waveguide axis, said rotary center being located between two adjacent radiation waveguides of said plurality of radiation waveguides;

a feed waveguide located on the same surface plane as said plurality of radiation waveguides, and having a feed section for composing a composite wave with electromagnetic waves received at said radiation waveguides, and for transmitting said composite wave to said converter through said feed section, wherein said feed section is located at said rotary center; and a feed probe for electrically connecting said feed section and said converter;

wherein said feed waveguide includes a first section extended along first ends of said radiation waveguides, and a second section juxtaposed in parallel with said radiation waveguides and extended from said feed section to said first section between said two adjacent radiation waveguides of said plurality of radiation waveguides.

2. The slotted leaky waveguide array antenna as set forth in claim 1, wherein said plurality of slots are crossed slots having an identical offset from the waveguide axis.

3. The slotted leaky waveguide array antenna as set forth in claim 2, wherein the number of said slots is 12–17 for each of said radiation waveguides.

4. The slotted leaky waveguide array antenna as set forth in claim 1, wherein the number of said radiation waveguides is 12 or more.

5. A slotted leaky waveguide array antenna as set forth in claim 1, wherein said rotary center is located around a center of gravity of said antenna.

6. A slotted leaky waveguide array antenna to be connected to a converter, having a rotary center about which said antenna is to be rotated in a substantially horizontal plane for tracking an azimuth direction, said slotted leaky waveguide array antenna comprising:

a plurality of radiation waveguides closely juxtaposed in parallel to each other on a surface plane, each of said plurality of radiation waveguides having a waveguide axis and having a plurality of slots arranged in a direction of said waveguide axis; and a feed waveguide located on the same surface plane as said plurality of radiation waveguides, and having a feed section for composing a composite wave with electromagnetic waves received at said radiation waveguides, and for transmitting said composite wave to said converter through said feed section, wherein said feed section is located at said rotary center;

wherein said feed waveguide includes a first section extended along first ends of said radiation waveguides and a second section extended from said feed section to said first section between said radiation waveguides.

7. A slotted leaky waveguide array antenna according to claim 6 wherein said second section is juxtaposed in parallel with said radiation waveguides.

8. A slotted leaky waveguide array antenna according to claim 6 wherein said second section is extended from said feed section to said first section between said two adjacent radiation waveguides of said plurality of radiation waveguides.

9. A slotted leaky waveguide array antenna according to claim 6 further comprising a feed probe for electrically connecting said feed section and said converter.

10. A slotted leaky waveguide array antenna according to claim 6 wherein said rotary center is located between two adjacent of said plurality of radiation waveguides.

11. A slotted leaky waveguide array antenna according to claim 6 wherein said plurality of slots are crossed slots having an identical offset from the waveguide axis.

12. A slotted leaky waveguide array antenna according to claim 6 wherein said rotary center is located around a center of gravity of said antenna.

* * * * *